US006228217B1

(12) United States Patent
Dickerson et al.

(10) Patent No.: US 6,228,217 B1
(45) Date of Patent: May 8, 2001

(54) STRENGTH OF PAPER MADE FROM PULP CONTAINING SURFACE ACTIVE, CARBOXYL COMPOUNDS

(75) Inventors: Jay A. Dickerson, Claymont, DE (US); Harry J. Goldy, Woodlyn; Douglas C. Smith, Landenberg, both of PA (US); Ronald R. Staib, Wilmington, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 08/372,083

(22) Filed: Jan. 13, 1995

(51) Int. Cl.[7] ..... D21H 17/03; D21H 17/23; D21H 17/33

(52) U.S. Cl. ..... 162/158; 162/163; 162/164.1; 162/164.3; 162/164.6; 162/168.1; 162/168.2; 162/168.3; 162/175; 162/179; 162/181.1; 162/181.2; 162/183

(58) Field of Search ..... 162/164.1, 164.3, 162/164.6, 168.2, 168.1, 168.3, 183, 163, 179, 158, 175, 181.1, 181.2

(56) References Cited

U.S. PATENT DOCUMENTS

| | | | |
|---|---|---|---|
| 2,884,057 | 4/1959 | Wilson et al. | 162/164 |
| 2,963,396 | 12/1960 | Padbury et al. | 162/168 |
| 3,049,469 | 8/1962 | Davison | 162/164 |
| 3,269,891 | 8/1966 | Reynolds et al. | 162/169 |
| 3,303,184 | 2/1967 | Nordgren | 260/209 |
| 3,332,834 | 7/1967 | Reynolds | 162/164 |
| 3,344,016 | 9/1967 | Moggio et al. | 162/146 |
| 3,660,338 | 5/1972 | Economou | 260/29.6 |
| 3,677,888 | 7/1972 | Economou | 162/164 |
| 3,819,555 | 6/1974 | Kaufman | 260/29.4 |
| 3,840,489 | 10/1974 | Strazdins | 260/29.6 |
| 3,874,994 | 4/1975 | Sedlak | 162/163 |
| 3,875,097 | 4/1975 | Sedlak | 260/29.4 |
| 3,875,098 | 4/1975 | Sedlak | 260/29.4 |
| 4,002,588 | 1/1977 | Strazdins | 260/29.6 |
| 4,088,530 | 5/1978 | Chan et al. | 162/168 |
| 4,167,439 | 9/1979 | Killam | 162/163 |
| 4,347,100 | 8/1982 | Brucato | 162/10 |
| 4,643,801 | 2/1987 | Johnson | 162/164.1 |
| 4,702,844 | 10/1987 | Flescher et al. | 210/733 |
| 4,753,710 | 6/1988 | Langley et al. | 210/733 |
| 5,338,406 | 8/1994 | Smith | 162/168.2 |
| 5,501,772 | 3/1996 | Elliott et al. | 162/163 |
| 5,501,773 | 3/1996 | Elliott et al. | 162/163 |
| 5,567,277 | 10/1996 | Elliott et al. | 162/163 |

FOREIGN PATENT DOCUMENTS

| | | | |
|---|---|---|---|
| 54097 | 2/1986 | (AU) . | |
| 477265 | 9/1951 | (CA) . | |
| 1110019 | 10/1981 | (CA) . | |
| 193111 | 9/1986 | (EP) . | |
| 03262770 | 7/1994 | (EP) . | |
| 57-191394A | 11/1982 | (JP) . | |
| 8500507 * | 9/1986 | (NL) | 162/175 |
| WO 93/01352 | 1/1993 | (WO) . | |
| 78/2037 | 4/1978 | (ZA) . | |

OTHER PUBLICATIONS

Worster, H.E. et al., TAPPI, 63(11), p. 63 (1980).
Bruun, H.H. et al., Svensk Papperstidning, 78(14), p. 512 (1975).
Springer, A.M. et al., TAPPI, 69(4), p. 106 (1986).
Brandel, J. et al., Pulp and Paper Mag. of Canada, p. T–431 (1966).
Allen, L.H., TAPPI, 71(1), p. 61 (1988).
Young et al., J. Colloid and Interface Sci., 61(2), p. 287 (1977).
Davison, R.W., TAPPI, 47(10), p. 609 (1964).
Back, E., Svensk Papperstidning, 59(9), p. 319 (1956).
Allen, L.H., TAPPI, 63(2), p. 81 (1980).
Reynolds, W.F., *Dry Strength Additives*, Tappi Press, 1980, Chapter 6, p. 125.
Strazdins, E., First International Seminar on Paper Mill Chemistry, Amsterdam, Sep. 11–13, 1977, pp. 1–25.
Drew, J., Chem. Eng. Prog., 72(6), p. 64 (1976).
Wang et al., Ind. Eng. Chem, Prod. Res. Dev., 14(4), p. 312 (1975).
J. Drew and M. Propst, *Tall Oil*, Pulp Chemicals Assn., New York, 1981, pp. 170–175.
Abstract Bulletin of the Institute of Paper Chemistry, 51(11), May, 1981, p. 1241, No. 11644.
Springer et al., TAPPI, 68(4), p. 78 (1985).
Springer et al., *Southern Pulp and Paper*, Mar., 1984, p. 21.
*Database W/PIL, No. 83–744757*, Derwent Publication Ltd., London, Oct. 5, 1983.
Rydholm, S.A., *Pulping Processes*, Interscience Publishers, New York, 1967, pp. 1135–1138.
Linhart et al., TAPPI, Oct., 1987, p. 79.
Auhorn et al., "Improved Efficiency of Wet End Additives in Closed Wet End Systems through Elimination of Detrimental Substances", TAPPI Papermakers Conference, TAPPI Press, Atlanta, 1979.

* cited by examiner

*Primary Examiner*—Peter Chin
(74) *Attorney, Agent, or Firm*—Martin F. Sloan; Mark A. Hagedorn

(57) ABSTRACT

This invention is directed to a process for preparing an aqueous papermaking suspension containing a polyelectrolyte complex comprising providing an aqueous suspension of pulp fibers containing a water-soluble cationic polymer and a water-soluble anionic polymer that are reactable in the aqueous suspension to form the polyelectrolyte complex, and a multivalent cation having at least a +3 charge, and forming the polyelectrolyte complex. It also includes the process wherein the aqueous suspension of pulp fibers contains surface active carboxyl compounds and water-soluble anionic compounds. It further includes the process wherein the aqueous papermaking suspension is sheeted and dried to obtain paper of improved strength.

46 Claims, No Drawings

STRENGTH OF PAPER MADE FROM PULP CONTAINING SURFACE ACTIVE, CARBOXYL COMPOUNDS

FIELD OF THE INVENTION

This invention relates to a process for making paper from pulps containing surface active, carboxyl compounds with increased strength levels over paper made conventionally from such pulps, and also to the improved paper made by that process.

BACKGROUND OF THE INVENTION

The process for manufacturing paper conventionally comprises three principal steps: (1) forming an aqueous suspension of cellulosic fibers, commonly known as pulp; (2) adding strengthening and/or sizing materials; and (3) sheeting and drying the fibers to form the desired cellulosic web.

Wood, the most widely utilized source of cellulose pulp, contains a mixture of compounds known as extractives, which are composed of a complicated mixture of various rosin acids, fatty acids, fats, waxes, and other low molecular weight neutral compounds. The specific composition of the extractives varies with the wood species.

During the manufacture of unbleached wood pulp by any of the well-known alkaline processes, the free acids and esters found in the wood extractives are converted to surface active, sodium salts of fatty and resin acids. These materials are commonly referred to as tall oil soaps. In the acid and mechanical pulping processes, the extractives remain essentially unchanged, but some of these compounds may be carried into the papermaking process as a result of incomplete washing.

Fatty acids and other surface active, carboxyl compounds can also be introduced into pulp as a result of the addition of defoamers, wetting agents, retention aids and wire cleaners. Such addition at several locations can result in high levels in the pulp. Fatty acids and other surface active, carboxyl compounds can also be introduced into pulp during the de-inking process practiced during the recycling of some printed papers. When these surface active, carboxyl compounds are present in the paper making process, they will be present in the liquid phase and adsorbed onto the fiber surface, as free acids, sodium salts, or as salts of divalent metal ions.

Tall oil soaps and other surface active materials are known to adversely affect the strength of paper and the performance of strength additives when present in the papermaking system, even when present at levels as low as 0.05% (Worster, H. E., et.al. *TAPPI* 63(11) 63 (1980), Bruun, H. H. *Svensk Papperstidning* 78(14)512(1975), Springer, A. M., et. al. *TAPPI Journal* 69(4)106(1986), Brandel, J., and Lindheim, A., *Pulp and Paper Mag. Can.* T-431 (1966)). Normally, the pulps containing surface active, carboxyl compounds at levels sufficient to interfere with the performance of strength-enhancing additives, such as acrylamide copolymers, are unbleached pulps.

An improved process for making paper with increased strength using unbleached pulp containing soluble anionic materials, also known as anionic trash, using a combination of a water-soluble linear cationic polymer having a high molecular weight and a water-soluble anionic polymer that is reactable in the presence of water with the cationic polymer to form a polyelectrolyte complex, is disclosed in U.S. Pat. No. 5,338,406, which is incorporated herein by reference in its entirety. However, when used with some pulps, particularly those containing tall oil soaps and other surface active materials, that process is not fully effective to make paper with sufficient strength.

Tall oil soaps and other surface active carboxyl compounds are well known to interact with multivalent cations to form metal soaps; see, for instance, Allen, L. H., *TAPPI Journal* 71(1) 61 (1988), and Young, S. L., and Matijevic, E. *J. Colloid Interface Sci.* 61(2) 287 (1977)). The products of these interactions, particularly those involving aluminum ions derived from alum, have found many uses in the paper industry.

On the other hand, addition of alum, or alum in the presence of surface active carboxyl compounds, to a papermaking process is well known to have an adverse effect on the strength properties of the paper. This is particularly true when high levels of these materials are added. (See Worster, H. E., et.al. *TAPPI* 63(11) 63 (1980)). It is on this basis that papermakers generally try to minimize the amount of alum they use.

Alum is aluminum sulfate, $Al_2(SO_4)_3$, with various amounts of water of hydration. It is widely employed in the paper industry to fix rosin size, increase drainage, improve retention, and reduce anionic charge. For example, alum is widely used in combination with rosin, a component of tall oil, to make a size for paper. The rosin aluminate formed by the interaction between these two materials adsorbs on the fiber surface and renders it hydrophobic. In unbleached papermaking systems, it is normally employed for these purposes at addition levels less than 1%. An excellent review of this chemistry can be found in Davison, R. W. *TAPPI* 47(10) 609 (1964). Alum has sometimes also been recommended as a pitch control agent (See Back, E., *Svensk Papperstidning* 59(9) 319 (1956), and Allen, L. H., *TAPPI* 63(2)81(1980)).

Alum is also used in combination with anionic acrylamide copolymers, to improve the dry strength of paper (Azorlosa, Canadian Patent No. 477,265) where it acts as a retention aid for these anionic copolymers. Alum may also be used in papermaking systems where cationic resins are used, for example, as a component of the sizing system, as a dye fixative, or as a drainage aid (Reynolds, W. F. in "Dry Strength Additives", Tappi Press. Atlanta, Ga. 1980. Chapter 60). For instance, alum has been employed along with the certain cationic, hydrophobic dry strength additives disclosed by Strazdins in U.S. Pat. No. 3,840,489 to neutralize the soluble anionic material found in unbleached pulp. That material has been shown to interfere with the ability of the resin to enhance strength (Strazdins, E. *International Seminar of Paper Mill Chemistry*, Amsterdam 1:26p, Sep. 11–13, 1977).

It has now been discovered that the use of alum in conjunction with certain cationic and anionic polymers can improve the strength of paper made from pulps containing surface active carboxyl compounds.

SUMMARY OF THE INVENTION

This invention pertains to a process for preparing an aqueous papermaking suspension containing a polyelectrolyte complex, comprising:

a) providing an aqueous suspension comprised of pulp fibers and surface active carboxyl compounds;

b) adding to said aqueous suspension a water-soluble cationic polymer and a water-soluble anionic polymer that are reactable in the aqueous suspension to form the polyelectrolyte complex, and a multivalent cation having at least a +3 charge; and c) forming the polyelectrolyte complex.

In a preferred embodiment of the invention the aqueous suspension of pulp fibers containing surface active carboxyl compounds also contains water-soluble anionic polymer capable of reacting to form a polyelectrolyte complex.

The invention also encompasses the process wherein the aforementioned aqueous papermaking suspensions are sheeted and dried to obtain paper of improved strength. This process according to the invention is particularly useful in the manufacture of linerboard and corrugated board with increased compression strength at higher production rates. It also improves other strength properties, such as tensile, burst, stretch, and internal bond strengths, and tensile energy absorption, and may be used for making paper with improved strength, from pulp containing surface active, carboxyl compounds, whenever the required levels of alum can be tolerated.

DETAILED DESCRIPTION OF THE INVENTION

The first step in practicing the process of this invention, forming an aqueous suspension of cellulosic pulp fibers, is performed by conventional means, such as known mechanical, chemical and semichemical pulping processes. After the mechanical grinding and/or chemical pulping step, the pulp is washed to remove residual pulping chemicals and solubilized wood components. These steps are well known, for instance, as described in Casey, *Pulp and Paper* (New York, Interscience Publishers, Inc. 1952), the disclosure of which is incorporated by reference.

The level of surface active, carboxyl compounds present in the liquid phase may be determined by ether extraction followed by titration with base, a modification of the conventional procedure used to determine tall oil soaps in black liquor. Unless the exact chemical composition of the extract is known, this procedure can only estimate the weight of surface active carboxyl compounds present. It is possible to extract whole pulp samples in order to obtain an estimate of the level of these materials.

Tall oil soaps are widely known to be present in many unbleached pulps (Drew, J. *Chem Eng. Prog.* 72(6): 64 (1976)). The lower levels of these materials in bleached pulps is primarily due to the additional washing stages encountered during the bleaching process. The level of surface active, carboxyl compounds in bleached pulp is extremely low, less than about 0.05% by weight, based on dry weight of fiber. Estimates of the levels of surface active, carboxyl compounds in unbleached pulp range from about 0.05% to about 10% by weight based on the dry weight of fiber.

In the second step of the process of the invention the aqueous suspension of pulp fibers is provided with a water-soluble cationic polymer and a water-soluble anionic polymer that are reactable to form a polyelectrolyte complex, and a multivalent cation having at least a +3 charge. The multivalent cation is added prior to the addition of the water-soluble anionic polymer.

The water-soluble cationic and anionic polymers which are preferred in the practice of this invention are described in the said U.S. Pat. No. 5,338,406 and in European Patent Application Number 89118245.3, the disclosures of which are incorporated herein by reference.

As applied to such cationic and anionic polymers, "water-soluble" means that the polymers can form a non-colloidal 1% aqueous solution. As applied to the cationic polymers, "linear" means that the polymers are straight-chained, with no significant branching present. Exemplary polymers are described below.

Polymer charge density can be determined based on the known structure of the polymer by calculating as follows:

$$\text{charge density (meq/g)} = \frac{1000}{\text{molecular weight per charge}}.$$

It may also be determined by experimentation, for instance, by using the colloidal titration technique described by L. K. Wang and W. W. Schuster in *Ind. Eng. Chem., Prd. Res. Dev.*, 14(4)312 (1975), the disclosure of which is incorporated herein by reference.

Molecular weight is expressed herein in terms of the polymers reduced specific viscosity (RSV) measured in a 2 M NaCl solution containing 0.05 weight percent of the polymer at 30° C. Under these conditions, a cationic acrylamide copolymer of molecular weight $1\times10^6$ has a RSV of approximately 2 dl/g.

The cationic polymers of this invention are water soluble, high molecular weight, low charge density, quaternary ammonium polymers. Preferably they are linear polymers. The cationic polymers have a RSV greater than about 2 dl/g, preferably in the range of about 7 to about 25 dl/g. They have a charge density in the range of from about 0.2 to about 4 meq/g, preferably about 0.5 to about 1.5 meq/g. Optimum performance is obtained with cationic polymers having a charge density of about 0.8 meq/g. Exemplary cationic polymers include polysaccharides such as cationic guar (e.g., guar derivatized with glycidyltrimethylammonium chloride) and other natural gum derivatives, and synthetic polymers such as copolymers of acrylamide. The latter include copolymers of acrylamide with diallyldimethylammonium chloride (DADMAC), acryloyloxyethyltrimethylammonium chloride, methacryloyloxyethyltrimethyl ammonium methylsulfate, methacryloyloxyethyltrimethyl ammonium chloride (MTMAC) or methacrylamidopropyltrimethyl ammonium chloride. Preferred are copolymers of acrylamide with DADMAC or MTMAC.

Some of the cationic polymers described above may undergo hydrolysis of their ester linkages under conditions of high temperature, extreme pH's, or extended storage. This hydrolysis results in the loss of cationic charge and the introduction of anionic sites into the polymer. If sufficient hydrolysis occurs, the polymer solution may become hazy. However, this hydrolysis has been found to have no significant effect on the performance of the polymer so long as the net cationic charge density (sum of cationic polymer charge density (meq. +/g) plus anionic polymer charge density (meq. −/g)) remains within the ranges specified.

The cationic polymer addition levels may range between about 0.1 and about 5%, based on pulp dry weight. The preferred addition level range is between about 0.2 and about 3.0%, and the most preferred addition level range is between about 0.3 and about 1%, based on dry pulp weight.

The anionic components of this invention include those normally present in unbleached pulps such as solubilized lignins and hemicelluloses; synthetic anionic polymers; and anionically modified natural polymers (i.e., those other than lignins and hemicelluloses). When present in the papermaking process in sufficient quantity, the anionic polymers normally present in unbleached pulps are preferred. The anionic polymers preferably have a charge density of less than about 5 meg/g. An important class of anionic polymers of this invention are those water soluble anionic polymers normally found in unbleached pulp, selected from the group consisting of solubilized lignins and hemicelluloses, sulfonated lignins, oxidized lignins, kraft lignin, and lignin sulfonates. These polymers may be present in the pulp or may be added as part of the process.

Solubilized lignins and hemicelluloses are normally present in unbleached pulps as a result of incomplete removal of materials solubilized during manufacture of the pulp. Such products result from both chemical and mechanical pulping. Typically, pulping liquors, such as kraft black liquor or neutral sulfite brown liquor, comprise solubilized lignin and hemicellulose.

The level of these soluble anionic materials normally found in pulp varies over the range of about 0.1 to 5%, depending on the pulp type. The amount needed to obtain the desired dry strength improvement depends on the type and amount of cationic polymer added to the pulp, the type and amount of anionic polymer found in the pulp, the type and amount of anionic polymer added to the pulp, the amount of alum added to the pulp, and the addition sequence employed.

The anionic polymer addition level may range between about 0.1 and about 25%. More preferably, the anionic polymer addition level may range between about 0.2 and about 5%. Most preferably, the anionic polymer addition level should be between about 0.25 and about 2.5%.

At a given cationic polymer addition level, the strength improvements increase with increasing anionic polymer level, until reaching either a plateau or a maximum. This point normally occurs when the maximum weight of polyelectrolyte complex is formed. The maximum amount of polyelectrolyte complex is formed approximately at the point where there is one anionic molecule for each charge on the cationic polymer.

Other anionic polymers normally employed as dry strength additives can be substituted for the water soluble anionic polymers normally found in unbleached pulp. Exemplary synthetic anionic polymers and anionically modified natural polymers include copolymers of acrylamide and sodium acrylate, sodium methacrylate, and sodium-2-acrylamide-2-methylpropane sulfonate; sodium carboxymethylcellulose; sodium carboxymethyl guar; sodium alginate; sodium polypectate; and poly(sodium-2-acrylamide-2-methylpropane sulfonate). They may be used singly or in any combination.

Also useful are anionically modified forms of lignin and hemicellulose, such as are obtained for example by oxidation, sulfonation or carboxymethylation. Oxidized and sulfonated lignins and hemicelluloses are by-products of the pulping process and are normally present in unbleached pulps useful in this invention. The naturally present lignins and hemicellulose may also be modified by conventional synthetic processes such as oxidation, sulfonation and carboxymethylation.

The multivalent cation having at least a +3 charge for use in this invention comprises a cation selected from the group consisting of aluminum, iron, chromium, indium, rhodium, yttrium, lanthanum, cerium and praseodymium. Most preferred is aluminum, particularly aluminum supplied by alum.

The preferred level of compound containing multivalent cation depends on the total level of surface active, carboxyl compounds. Since the total level of surface active, carboxyl compounds cannot be accurately determined, it is best to determine the level of compound required empirically, by making handsheets with different levels of compound containing the multivalent cation.

When the compound containing the multivalent compound is alum, the preferred amount of alum depends on the source and type of the anionic polymer. When the anionic polymer used is the anionic polymer found in pulp, the preferred amount of alum is from about 0.4 to about 6% based on the weight of the dry pulp. The more preferred amount of alum is from about 0.4 to about 4%, and most preferred amount from about 0.4 to about 2.5%.

When the anionic polymer is a synthetic anionic polymer or an anionically modified natural polymer, the preferred amount of alum is from about 1 to about 6% based on the weight of the dry pulp. The more preferred amount of alum is from about 1.25 to about 4%, and most preferred amount from about 1.5 to about 2.5%.

If the compound containing the multivalent cation is not alum, preferably the amount of the compound containing the multivalent cation is such as to provide an amount of the cation equivalent on a molar basis to the amount of aluminum provided by the said amount of alum.

Alum may be added over the pH range 5.5 to 11 without affecting its efficiency in the process according to the invention. The alum, cationic polymer, and anionic polymer may be added at any pH over the range from about 4 to about 12.5. Normally, the pH's encountered at the points in the papermaking process where these materials are added will be between 5 and 11. The addition of alum will normally lower the pH of the papermaking furnish. It may, therefore, be necessary to add sodium hydroxide, or some other base, to maintain the pH of the papermaking process within the desired range of 4.5 to 8.5. This may be done at any point in the process.

In the second step of the process, the preferred sequence of addition of the three components is alum, the cationic polymer, and finally the anionic polymer. If the preferred sequence of addition of the three components is not practical in a particular commercial application, it is possible according to the invention to use other sequences. However, the sequence of addition may affect the magnitude of strength improvement obtained. The individual components and blends of the components may be dry or they may be in aqueous systems. Further, this step may be carried out by forming an aqueous system comprising the polyelectrolyte complex, or polymer or polymers, and adding the same to the papermaking system.

It may be also be desirable to mix the alum and cationic polymer together before addition to the papermaking system. While there can be some reduction in efficiency of the additive as a result of this mixing, the lower polymer solution viscosities obtained make materials handling considerably easier.

The third step in the process of this invention is the formation of the polyelectrolyte complex. The polyelectrolyte complex that forms from the mixture of cationic and anionic polymers may be soluble, partially soluble or insoluble in water. Thus, it forms what may be conventionally termed a "solution", "suspension", or "dispersion", etc. Herein, to avoid confusion, the generic term "aqueous system" will be used to refer to such mixtures. In some instances the term "aqueous system" is also used with respect to aqueous mixtures of the water-soluble polymers that form the polyelectrolyte complex.

The polyelectrolyte complex forms when the components are mixed in an aqueous system, preferably under high shear. It may be formed and then added during the papermaking process, or may be formed in the papermaking process. In the latter instance, the cationic component may be added by itself to react with naturally present anionic polymers or may be simultaneously or successively added with an anionic component. Here, the amount of each anionic polymer to be incorporated in the polyelectrolyte complex is reduced to take into account the amount of that polymer already in the system.

The specific amount and type of polyelectrolyte complex that is preferable will depend on, among other things, the characteristics of the pulp; the presence or absence of black liquors and, where present, the amount and nature thereof; characteristics of the polymers used to form the complex; the characteristics of the complex; the desirability of transporting an aqueous system comprising the polyelectrolyte complex; and the nature of the papermaking process in which the aqueous system is to be used.

The polyelectrolyte complex will typically comprise polymers in a ratio of cationic polymer(s) to anionic polymer(s) of from about 1:25 to about 40:1, preferably from about 1:4 to about 4:1. Aqueous systems formed prior to addition to the pulp normally comprise 0.1 to 10 weight percent, based on the weight of the water in the system, of the polyelectrolyte complex. Generally, the polyelectrolyte complex is effective when added to the stock in an amount of about 0.1 to about 15%, preferably about 0.2 to about 3%, by dry weight of the pulp.

The anionic charge fraction is indicative of the nature of the polyelectrolyte complex. It can be determined by the following formula:

$$\text{anionic charge fraction} = \frac{\text{total anionic charge}}{\text{total anionic charge} + \text{total cationic charge}}$$

in which the total anionic charge is determined by multiplying the absolute value of the charge density (electrostatic charge per weight of polymer, e.g., in meq/g) of each anionic polymer forming the polyelectrolyte complex by the weight of that polymer in the polyelectrolyte complex and adding the total charge of all of the anionic polymers. The total cationic charge is determined by multiplying the charge density of each cationic polymer forming the polyelectrolyte complex by the weight of that polymer in the polyelectrolyte complex and adding the total charge of all of the cationic polymers.

Generally, the polyelectrolyte complex is completely soluble at an anionic charge fraction of less than about 0.2, colloidal at an anionic charge fraction of about 0.2 to about 0.4, and fibrous (in some instances as a stringy gel that precipitates from solution, but which becomes colloidal under high shear) at an anionic charge fraction greater than about 0.4. Polyelectrolyte complexes of this invention generally have an anionic charge fraction of about 0.1 to about 0.98, preferably an anionic charge fraction of about 0.3 to about 0.8, and more preferably about 0.45 to about 0.6. All polyelectrolyte complexes of this invention provide enhanced dry strength, particularly in the presence of black liquors.

However, except as described below, the fibrous polyelectrolyte complexes (particularly those having the more preferred anionic charge fraction listed above) provide larger improvement in dry strength than colloidal or water-soluble polyelectrolyte complexes prepared from the same polymers. Under high shear in paper-making, these fibrous particles break into colloidal particles that provide excellent dry strength properties. Unique properties are obtained by forming the polyelectrolyte complex by mixing the anionic and cationic components in an aqueous system at a temperature of at least about 75° C. and letting the mixture cool to less than about 60° C., preferably less than about 50° C. This can be achieved by adding the dry powder polymers to water heated to at least 75° C. and, then, allowing the resultant aqueous system to cool to less than about 60° C. Premixing of the polymers into a dry polymer mixture may facilitate handling.

The same properties can be obtained by preparing separate aqueous systems of the anionic and cationic polymers, heating each of the aqueous systems to at least 75° C., mixing them together, and, then, allowing the resultant aqueous system to cool to less than about 60° C. Polyelectrolyte complexes prepared by these processes generally have an anionic charge fraction of about 0.1 to about 0.98, preferably about 0.4 to about 0.9, and most preferably about 0.65 to about 0.85. High shear mixing aids in the rapid preparation of these polyelectrolyte complexes, but is not necessary. Maintaining the temperature of the preparation solution, dispersion, or slurry above about 75° C. for about one hour aids in the homogenization of the mixture.

Polyelectrolyte complexes having an anionic charge fraction of less than about 0.2 prepared by heating to at least 75° C. and cooling will be water-soluble and perform in the same manner to those having the same anionic charge fraction prepared at lower temperatures. Polyelectrolyte complexes with anionic charge fractions of from about 0.2 to less than about 0.65 form colloidal particles that perform similar to the colloidal and fibrous particles prepared without heating to at least 75° C. and cooling.

When the anionic charge fraction is about 0.65 or higher and the polyelectrolyte complexes are prepared by heating to at least 75° C. followed by cooling, water soluble polyelectrolyte complexes are obtained that perform even better as dry strength additives than the other species of this invention. These soluble polyelectrolyte complexes are also useful as shear activated flocculants, retention aids on high speed paper machines, viscosifiers and drag reduction agents, and in water treatment.

Water-soluble complexes can be prepared from all of the aforementioned types of anionic components. However, temperatures are not normally sufficiently high during papermaking for formation of such a water-soluble polyelectrolyte complex. Therefore, to use those anionic polymers normally present in unbleached pulps, it is necessary to separate the anionic component from the pulp. This separation is normally carried out in the papermaking process, making such anionic components readily available.

Water-soluble polyelectrolyte complexes can be prepared from, for example, poly(acrylamide-co-dimethyldiallylammonium chloride) and Marasperse N-3 sodium lignin sulfonate (Lignotech USA Inc., Greenwich, Conn.), or Aqualon™ CMC 7M (Aqualon Company, Wilmington, Del.), or southern pine black liquor; quaternary amine modified waxy maize starch and Marasperse N-22 sodium lignin sulfonate (Lignotech USA Inc., Greenwich, Conn.); poly(acrylamide-co-methylacryloxyethyltrimethylammonium chloride) and Marasperse N-3 sodium lignin sulfonate; and poly (acrylamide-co-methylacryloxyethyltrimethylammonium chloride) and Marasperse N-3 sodium lignin sulfonate. However, some combinations of cationic and anionic components prepared in this manner yield polyelectrolyte complexes having anionic charge fractions of 0.65 or higher that are particulate or colloidal and perform equivalent to their counterparts that are formed without heating to at least 75° C. and cooling.

Other additives useful in the papermaking process may also be employed while practicing this invention. These may include wet strength resins, sizing agents, fillers, defoamers, retention aids, optical brighteners, wetting agents, biocides, felt and wire cleaners, acids, inorganic salts, and bases.

The specific mechanism by which this invention improves paper strength is not completely understood. The discussion which follows is for information only and is not intended to limit the scope of the invention.

Unbleached pulps contain two types of materials that interfere with the performance of chemical strength additives: 1) anionic polyelectrolytes and 2) surface active compounds. The above-mentioned U.S. Pat. No. 5,338,406 discloses a method for overcoming the adverse effect of the anionic polyelectrolytes. The present invention is intended to overcome the adverse effect of a large portion of the compounds that fall within the second class, in particular, those surface active compounds containing carboxyl functionality.

The surface active compounds are believed to interfere with the development of paper strength by two mechanisms: 1) reduced surface tension, which reduces the consolidation forces generated as a sheet of paper dries, and/or 2) formation of a weak boundary layer between bonding fibers as a result of adsorption of low melting point (viscous, mechanically weak, or low strength) compounds onto the fiber surface.

The addition of alum to papermaking systems containing these surface active, carboxyl compounds results in the formation of insoluble, high melting point salts. Because the salts are insoluble, they no longer lower surface tension, and because they are high melting, they no longer form such a weak boundary layer on the fiber surface. As a result, the chemical strength additive formed by the interaction between the anionic and cationic polymers is able to function effectively.

This invention therefore provides a method for improving the strength of paper made from pulps containing soluble polyanionic materials and/or surface active carboxyl compounds. In addition to improving strength, this invention has also been found to: 1) improve sizing of paper when practiced at a papermaking pH below 7; 2) increase the coefficient of friction of paper; and 3) improve the drainage characteristics of the papermaking furnish.

The primary anticipated use for this invention is in the manufacture of linerboard and corrugating medium with increased compression strength. It will be particularly useful for enabling manufacturers of these products to make high performance products at higher production rates.

The following Examples are presented to illustrate the invention. The procedures used are as follows:

Polymer molecular weight is expressed in terms of the polymers reduced specific viscosity (RSV) measured in a 2M NaCl solution containing 0.05 weight percent of the polymer at 30° C. Under these conditions, a cationic acrylamide copolymer of molecular weight $1\times10^6$ has a RSV of approximately 2 dl/g.

The tall oil soap (TOS) content of the pulps is determined by a procedure adapted from TAPPI T 645 Om-89, Analysis of tall oil skimmings, and from "Determination of tall oil soap in black liquor", found in *Tall Oil*, J. Drew and M. Propst, Pulp Chemicals Assn., New York, 1981, the disclosure of which is incorporated by reference. A sample of pulp filtrate is obtained at pH 9, the pH is adjusted to 2, and then exhaustively extracted with diethylether. Tall oil, found in the diethylether, is determined by titration with methanolic KOH in isopropanol.

EXAMPLES 1–5

These examples illustrate strength improvements obtained by forming a polyelectrolyte complex in the presence of alum by addition of cationic polymer, and additional black liquor solids to an unbleached pulp containing black liquor and tall oil soaps.

Handsheets were made on a Noble and Wood Sheet Machine (Noble and Wood Machine Co., Hoosick Falls, N.Y.) using the following:

1. Pulp: unbleached southern kraft pulp, containing 0.4% tall oil soap and black liquor as indicated by the presence of 0.45 ueq/g soluble polyanionic charge at pH 9, beaten to 697 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Black Liquor (Jefferson Smurfit Corporation): Total Solids: 40.5% (by Tappi Standard T650) Lignin: 11.9% (by UV spectroscopy) Charge density (by colloidal titration): 0.111 meq/g at pH 9.0

A 3920 ml sample of 2.5 weight % stock, from a well mixed batch of beaten pulp, was placed into a 4 liter metal beaker. Defoamer (0.025% based on weight of dry pulp) was added to the beaker and stirring was begun. The stock was transferred to the proportioner and diluted to 18 liters with the pH 5.5 standard hard water described above. Then, alum, a cationic copolymer (indicated in the following table), and black liquor, were added to the stock in the amounts, combinations, and sequences listed in Table 1 below, and the pH of the stock was adjusted to 5.5 with $H_2SO_4$, and then the stock was mixed for five minutes.

A clean thoroughly wetted screen was placed on an open deckle. The deckle was clamped closed and then filled with the 5.5 pH standard hard water (described above), from the white water return tank, to the bottom mark on the deckle box. A one liter aliquot of stock was drawn and poured into the deckle. The stock in the deckle was stirred using three rapid strokes of the dasher, the dasher was removed, and the deckle was drawn into the white water return tank. The screen and retained pulp was then transferred to the open felt at the entrance to the press. The felted sheets were run through the press with the press weights adjusted so as to obtain a pressed sheet having 33–34% solids. Then, the sheet and screen were placed in the drum dryer, having an internal temperature of 116° C. and a throughput time of 50–55 seconds, and run through two times (during the first run the sheet was in contact with the drum and during the second run the screen was in contact with the drum.). The sheets were conditioned at 22° C. and 50% relative humidity for 24 hours. Eight sheets were prepared in this manner, with the last five being used for testing.

The handsheets were evaluated by the following test: STFI Compression: Tappi Standard T826 ("Short Span Compressive Strength of Paperboard").

Results are shown in Table 1. The data in Table 1 show that improved results were obtained with respect to the STFI Compression Strength when alum, a cationic polymer of this invention, and black liquor were added to a commercial unbleached kraft pulp containing tall oil soap and soluble polianionic charge.

The best STFI Compression Strength results were obtained with samples containing alum, cationic polymer, and black liquor. Addition of either alum alone (Example 2), alum and cationic polymer (Example 3), or cationic polymer and black liquor (Example 4) resulted in significantly lower strength improvements than when the combination alum, cationic polymer, and black liquor was employed (Example 5).

TABLE 1

| Example Number | Additive 1 | Additive 2 | Additive 3 | STFI Compression (lbs/in) | % Improvement |
|---|---|---|---|---|---|
| 1 | — | — | — | 17.1 | — |
| 2 | 1.5% Alum | — | — | 17.0 | 0 |
| 3 | 1.5% Alum | 0.5% Cationic Polymer | — | 18.4 | 8 |
| 4 | 0.5% Cationic Polymer | 3% Black Liquor Solids | — | 18.7 | 9 |
| 5 | 1.5% Alum | 0.5% Cationic Polymer | 3% Black Liquor Solids | 20.1 | 18 |

EXAMPLES 6–13

These examples show the effect of addition sequence on the strength improvements obtained with this invention. Handshets were made on a Noble and Wood Sheet Machine (Noble and Wood Machine Co., Hoosick Falls, N.Y.) according to the procedure of Examples 1–5, with the following modifications:

1. Pulps: Six different pulps were used for these experiments.

Pulp A: Virgin unbleached kraft from southern softwood, Jefferson-Smurfit/CCA, Fernandina, Fla.

Pulp B: Virgin unbleached kraft from western softwood, International Paper, Gardiner, Oreg.

Pulp C: Virgin unbleached kraft from western softwood, Willamette Industries, Albany, Oreg.

pulp D: Repulped corrugated containers, Willamette Industries, Albany, Oreg.

Pulp E: Repulped corrugated containers, Willamette Industries, Port Hueneme, Calif.

Pulp F: Repulped corrugated containers, Menominee Paper Company, Menominee, Mich.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Black Liquor (Jefferson Smurfit Corporation):

Total Solids: 40.5% (by Tappi Standard T650)

Lignin: 11.9% (by UV spectroscopy)

Charge density (by colloidal titration): 0.111 meq/g at pH 9.0

Each addition sequence illustrated in Table 2 was carried out at least 6 times with a variety of the above pulps. The results listed in the table are the averages of the data obtained from the number of runs listed.

The results shown in Table 2 illustrate that the sequence for addition of cationic polymer, anionic polymer, and alum significantly affected the strength improvements obtained. The largest improvements were obtained using the sequence: 1) alum, 2) cationic polymer, 3) anionic polymer. While this is the preferred addition sequence, strength improvements are also obtained using other sequences.

TABLE 2

| Exp. No. | Number of Runs | Additive 1 | Additive 2 | Additive 3 | STFI Compression, lbs/in | % Improved |
|---|---|---|---|---|---|---|
| 6 | 14 | — | — | — | 16.3 | — |
| 7 | 6 | 0.5% Cationic Polymer | 3% Black Liquor Solids | — | 17.1 | 5 |
| 8 | 14 | 1.5% Alum | 0.5% Cationic Polymer | 3% Black Liquor Solids | 19.2 | 18 |
| 9 | 14 | 1.5% Alum | 3% Black Liquor Solids | 0.5% Cationic Polymer | 18.7 | 15 |
| 10 | 14 | 0.5% Cationic Polymer | 1.5% Alum | 3% Black Liquor Solids | 19.0 | 17 |
| 11 | 14 | 0.5% Cationic Polymer | 3% Black Liquor Solids | 1.5% Alum | 19.0 | 17 |
| 12 | 14 | 3% Black Liquor Solids | 1.5% Alum | 0.5% Cationic Polymer | 18.2 | 12 |
| 13 | 14 | 3% Black Liquor Solids | 0.5% Cationic Polymer | 1.5% Alum | 18.0 | 10 |

EXAMPLES 14–19

These examples show the effect of alum level on magnitude of strength improvement obtained. Handsheets were made on a Noble and Wood Sheet Machine (Noble and Wood Machine Co., Hoosick Falls, N.Y.) according to the procedure of Examples 1–5, with the following modifications:

1. Pulp: unbleached southern kraft pulp containing 0.4% tall oil soap and black liquor as indicated by the presence of 0.45 ueq/g soluble polyanionic charge at pH 9, beaten to 678 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Black Liquor (Jefferson Smurfit Corporation):
Total Solids: 40.5% (by Tappi Standard T650)
Lignin: 11.9% (by UV spectroscopy)
Charge density (by colloidal titration): 0.111 meq/g at pH 9.0

Results are shown in Table 3. Increasing levels of alum increased the magnitude of strength improvement obtained. Once sufficient alum was added to overcome the adverse effect of tall oil soap found in the pulp, no further improvements were obtained.

TABLE 3

| Example Number | Additive 1 | Additive 2 | Additive 3 | STFI Compression (lbs/in) | % Improvement |
|---|---|---|---|---|---|
| 14 | — | — | — | 19.1 | — |
| 15 | 0.5% Cationic Polymer | 3% Black Liquor Solids | — | 20.8 | 9 |
| 16 | 0.75% Alum | 0.5% Cationic Polymer | 3% Black Liquor Solids | 20.8 | 9 |
| 17 | 1.5% Alum | 0.5% Cationic Polymer | 3% Black Liquor Solids | 21.8 | 14 |
| 18 | 2.25% Alum | 0.5% Cationic Polymer | 3% Black Liquor Solids | 22.2 | 16 |
| 19 | 3.0% Alum | 0.5% Cationic Polymer | 3% Black Liquor Solids | 22.2 | 16 |

EXAMPLES 20–24

These examples show that lignin sulfonate can be used in place of the black liquor employed in previous examples. Handshets were made on a Noble and Wood Sheet Machine (Noble and Wood Machine Co., Hoosick Falls, N.Y.) according to the procedure of Examples 1–5, with the following modifications:

1. Pulp: unbleached southern kraft pulp, containing 0.47% tall oil soap and black liquor as indicated by the presence of 0.58 ueq/g soluble polyanionic charge at pH 9, beaten to 674 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Black Liquor (Jefferson Smurfit Corporation):
Total Solids: 40.5% (by Tappi Standard T650)
Lignin: 11.9% (by UV spectroscopy)
Charge density (by colloidal titration): 0.111 meq/g at pH 9.0

7. Lignin Sulfonate A: D-419-5, Lignotech USA. Calcium lignin sulfonate.

7. Lignin Sulfonate B: D-419-6, Lignotech USA. Sodium lignin sulfonate.

7. Lignin Sulfonate C: Norlig A, Lignotech USA. Calcium lignin sulfonate.

Results are shown in Table 4. Comparing the examples containing lignin sulfonate to the example containing black liquor, it can be seen that essentially the same results are obtained.

TABLE 4

| Example Number | Additive 1 | Additive 2 | Additive 3 | STFI Compression (lbs/in) | % Improvement |
|---|---|---|---|---|---|
| 20 | — | — | — | 16.8 | — |
| 21 | 3.0% Alum | 0.5% Cationic Polymer | 3% Black Liquor Solids | 19.9 | 18 |
| 22 | 3.0% Alum | 0.5% Cationic Polymer | 0.85% Lignin Sulfonate A | 19.6 | 17 |
| 23 | 3.0% Alum | 0.5% Cationic Polymer | 0.75% Lignin Sulfonate B | 19.3 | 15 |
| 24 | 3.0% Alum | 0.5% Cationic Polymer | 2% Lignin Sulfonate C | 18.8 | 12 |

EXAMPLES 25–33

These examples demonstrate the utility of this invention in paper made from recycled pulp. Handsheets were made on a Noble and Wood Sheet Machine (Noble and Wood Machine Co., Hoosick Falls, N.Y.) according to the procedure of examples 1–5, with the following modifications:

1. Pulp: Repulped corrugated containers (OCC pulp), containing 0.75% tall oil soap and black liquor as indicated by the presence of 0.01 ueq/g soluble polyanionic charge at pH 9, beaten to 566 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Lignin Sulfonate: D-419-5, Lignotech USA. Calcium lignin sulfonate.

Results are shown in Table 5. The same magnitude of strength improvement was obtained in the recycled pulp as was previously demonstrated with virgin unbleached kraft pulps. Furthermore, no strength improvements were obtained upon addition of only alum.

TABLE 5

| Example Number | Additive 1 | Additive 2 | Additive 3 | STFI Compression (lbs/in) | % Improvement |
|---|---|---|---|---|---|
| 25 | — | — | — | 16.4 | — |
| 26 | 0.5% Cationic Polymer | 1.2% Lignin Sulfonate | — | 18.3 | 12 |
| 27 | 1.5% Alum | 0.5% Cationic Polymer | 1.2% Lignin Sulfonate | 18.9 | 15 |
| 28 | 2.0% Alum | 0.5% Cationic Polymer | 1.2% Lignin Sulfonate | 19.4 | 18 |
| 29 | 2.5% Alum | 0.5% Cationic Polymer | 1.2% Lignin Sulfonate | 19.5 | 19 |
| 30 | 3.0% Alum | 0.5% Cationic Polymer | 1.2% Lignin Sulfonate | 19.0 | 16 |
| 31 | 3.5% Alum | 0.5% Cationic Polymer | 1.2% Lignin Sulfonate | 19.3 | 18 |
| 32 | 1.5% Alum | | | 15.9 | −3 |
| 33 | 3.0% Alum | | | 16.2 | — |

EXAMPLES 34–42

These examples demonstrate the effectiveness of the invention over the normal papermaking pH range. Handsheets were made on a Noble and Wood Sheet Machine (Noble and Wood Machine Co., Hoosick Falls, N.Y.) according to the procedure of examples 1–5, with the following modifications:

1. Pulp: OCC pulp, containing 1.5% tall oil soap and black liquor as indicated by the presence of 0.07 ueq/g soluble polyanionic charge at pH 9, beaten to 525 Canadian Standard Freeness (CSF) at pH 7.5.

2. Standard Hard Water: Standard hard water having 50 ppm alkalinity and 100 ppm hardness was prepared by adding $CaCl_2$ and $NaHCO_3$ to distilled water, and adjusting the pH to 5.5, 7.0, and 8.0 with $H_2SO_4$ or NaOH as required.

3. Defoamer: Defoamer 491A (Hercules Incorporated, Wilmington, Del).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Lignin Sulfonate: D-419-5, Lignotech USA. Calcium lignin sulfonate.

Results are shown in Table 6. The three component system, alum/polymer/black liquor, showed superior performance over the two component system, polymer/black liquor, over the entire pH range from 5.5 to 8.0.

TABLE 6

| Example Number | Additive 1 | Additive 2 | Additive 3 | pH | STFI Compression (lbs/in) |
|---|---|---|---|---|---|
| 34 | — | — | — | 5.5 | 15.1 |
| 35 | 0.5% Cationic Polymer | 1.5% Lignin Sulfonate | — | 5.5 | 16.1 |
| 36 | 2.25% Alum | 0.5% Cationic Polymer | 1.5% Lignin Sulfonate | 5.5 | 17.0 |

TABLE 6-continued

| Example Number | Additive 1 | Additive 2 | Additive 3 | pH | STFI Compression (lbs/in) |
|---|---|---|---|---|---|
| 37 | — | — | — | 7.0 | 15.4 |
| 38 | 0.5% Cationic Polymer | 1.5% Lignin Sulfonate | — | 7.0 | 16.4 |
| 39 | 2.25% Alum | 0.5% Cationic Polymer | 1.5% Lignin Sulfonate | 7.0 | 17.7 |
| 40 | — | — | — | 8.0 | 15.3 |
| 41 | 0.5% Cationic Polymer | 1.5% Lignin Sulfonate | — | 8.0 | 16.0 |
| 42 | 2.25% Alum | 0.5% Cationic Polymer | 1.5% Lignin Sulfonate | 8.0 | 17.9 |

EXAMPLES 43–46

These examples demonstrate that the alum and cationic polymer can be mixed prior to addition to the papermaking system with essentially the same results. Handsheets were made on a Noble and Wood Sheet Machine (Noble and Wood Machine Co., Hoosick Falls, N.Y.) according to the procedure of examples 1–5, with the following modifications:

1. Pulp: OCC pulp, containing 2.8% tall oil soap and black liquor as indicated by the presence of 0.85 ueq/g soluble polyanionic charge at pH 9, beaten to 552 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 7.2 with NaOH.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 9.5 mole % methylacryloxyethyltrimethylammonium chloride and 90.5 mole % acrylamide, having a RSV of 9.5 dl/g.

6. Lignin Sulfonate: D-419-5, Lignotech USA. Calcium lignin sulfonate.

Results are shown in Table 7. Mixing the alum with the cationic polymer prior to addition to the papermaking system slightly reduced the effectiveness of the additive. However this effect was offset by the much lower solution viscosity of the mixture, which makes the process more practical.

TABLE 7

| Example Number | Additive 1 | Additive 2 | Additive 3 | STFI Compression (lbs/in) | % Improvement |
|---|---|---|---|---|---|
| 43 | — | — | — | 15.6 | — |
| 44 | 3% Alum | 0.5% Cationic Polymer | 1.5% Lignin Sulfonate | 18.4 | 18 |
| 45 | 1.5% Alum | 0.5% Cationic Polymer mixed | 1.5% Lignin Sulfonate | 18.2 | 17 |

TABLE 7-continued

| Example Number | Additive 1 | Additive 2 | Additive 3 | STFI Compression (lbs/in) | % Improvement |
|---|---|---|---|---|---|
| | | with 1.5% Alum | | | |
| 46 | 0.5% Cationic Polymer mixed with 3% Alum | 1.5% Lignin Sulfonate | | 18.0 | 15 |

EXAMPLES 47–52

These examples demonstrate the effectiveness of other multivalent cations in comparison to alum. Handsheets were made on a Noble and Wood Sheet Machine (Noble and Wood Machine Co., Hoosick Falls, N.Y.) according to the procedure of Examples 1–5, with the following modifications:

1. Pulp: unbleached western kraft pulp, beaten to 620 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Polyaluminum Chloride: PHACSIZE, Diachem

6. Ferric Chloride: $FeCl_3$

7. Ferric Sulfate: $Fe_2(SO_4)_3$

8. Cationic Polymer A: Copolymer of 6.2 mole % diallyldimethylammonium chloride and 93.8 mole % acrylamide, having a RSV of 12.2 dl/g.

10. Cationic Polymer B: Copolymer of 9.5 mole % methylacryloxyethyltrimethylammonium chloride and 90.5 mole % acrylamide, having a RSV of 9.5 dl/g.

11. Black Liquor (Jefferson Smurfit Corporation):
Total Solids: 40.5% (by Tappi Standard T650)
Lignin: 11.9% (by UV spectroscopy)
Charge density (by colloidal titration): 0.111 meq/g at pH 9.0

12. Lignin Sulfonate: D-419-5, Lignotech USA. Calcium Lignin Sulfonate.

Results are shown in Table 8. Addition of either polyaluminum chloride (Example 50), ferric chloride (Example 51), or ferric sulfate (Example 52) provided similar strength improvements over paper made with only anionic and cationic polymer (Example 48) as did addition of alum (Example 49).

TABLE 8

| Example Number | Additive 1 | Additive 2 | Additive 3 | STFI Compression (lbs/in) | % Improvement |
|---|---|---|---|---|---|
| 47 | — | — | — | 19.5 | — |
| 48 | 0.5% Cationic Polymer A | 3% Black Liquor Solids | — | 20.7 | 6 |

TABLE 8-continued

| Example Number | Additive 1 | Additive 2 | Additive 3 | STFI Compression (lbs/in) | % Improvement |
|---|---|---|---|---|---|
| 49 | 1.5% Alum | 0.5% Cationic Polymer A | 3% Black Liquor Solids | 23.4 | 20 |
| 50 | 3% Poly-aluminum Chloride | 0.5% Cationic Polymer B | 1.5% Lignin Sulfonate | 22.8 | 17 |
| 51 | 2% FeCl3 | 0.5% Cationic Polymer A | 3% Black Liquor Solids | 21.8 | 12 |
| 52 | 0.5% Fe2(SO4)3 | 0.5% Cationic Polymer A | 3% Black Liquor Solids | 22.7 | 16 |

EXAMPLES 53–60

These examples illustrate that strength improvements are obtained with this invention even when the alum, polymer, and black liquor are added to papermaking stock over a wide pH range. Handsheets were made on a Noble and Wood Sheet Machine (Noble and Wood Machine Co., Hoosick Falls N.Y.) according to the procedure of Examples 1–5, with the following modifications:

1. Pulp: unbleached southern kraft pulp containing 0.4% tall oil soap and black liquor as indicated by the presence of 0.45 ueq/g soluble polyanionic charge at pH 9, beaten to 693 Canadian Standard Freeness (CSF) at pH 8.

2. Standard Hard Water: Standard hard water having 50 ppm alkalinity and 100 ppm hardness was prepared by adding $CaCl_2$ and $NaHCO_3$ to distilled water, and adjusting the pH to 5.5 with $H_2SO_4$.

3. Defoamer: Defoamer 491A (Hercules Incorporated, Wilmington, Del.).

4. Alum: Aluminum Sulfate, $Al_2(SO_4)_3$ $18H_2O$.

5. Cationic Polymer: Copolymer of 6.2 mole % diallyldimethylammonium chloride and 93.8 mole % acrylamide, having a RSV of 12.2 dl/g.

6. Black Liquor (Jefferson Smurfit Corporation):
Total Solids: 40.5% (by Tappi Standard T650)
Lignin: 11.9% (by UV spectroscopy)
Charge density (by colloidal titration): 0.111 meq/g at pH 9.0

Results are shown in Table 9. These examples show that alum, polymer, and black liquor can be added to stock over the pH range from about 6.0 to 11.0. The strength improvements did not appear to be affected significantly by the pH at which these additions were made.

TABLE 9

| Example Number | pH before additives | Additive 1 | Additive 2 | Additive 3 | STFI Compression (lbs/in) |
|---|---|---|---|---|---|
| 53 | 6.0 | — | — | — | 18.8 |
| 54 | 6.0 | 2% Alum | 0.5% Cationic Polymer | 3% Black Liquor Solids | 22.8 |
| 55 | 8.0 | — | — | — | 19.2 |

TABLE 9-continued

| Example Number | pH before additives | Additive 1 | Additive 2 | Additive 3 | STFI Compression (lbs/in) |
|---|---|---|---|---|---|
| 56 | 8.0 | 2% Alum | 0.5% Cationic Polymer | 3% Black Liquor Solids | 22.6 |
| 57 | 9.0 | — | — | — | 19.0 |
| 58 | 9.0 | 2% Alum | 0.5% Cationic Polymer | 3% Black Liquor Solids | 22.6 |
| 59 | 11.0 | — | — | — | 19.3 |
| 60 | 11.0 | 2% Alum | 0.5% Cationic Polymer | 3% Black Liquor Solids | 22.7 |

While the invention has been described with respect to specific embodiments, it should be understood that they are not intended to be limiting and that many variations and modifications are possible without departing from the scope of this invention.

What is claimed is:

1. A process for preparing an aqueous papermaking suspension containing pulp fibers and a polyelectrolyte complex, comprising:

a) providing an aqueous suspension comprised of pulp fibers and surface active carboxyl compounds;

b) adding to the aqueous suspension a water-soluble cationic polymer and a water-soluble anionic polymer that are reactable in the aqueous suspension to form the polyelectrolyte complex, and a compound containing a multivalent cation having at least a +3 charge; and c) forming the polyelectrolyte complex;

wherein said compound containing a multivalent cation is added at a level such as to provide an amount of cation equivalent on a molar basis to the amount of aluminum present in alum added at a level of from about 1.5% to about 6% based on the dry weight of pulp fibers.

2. The process of claim 1, wherein the aqueous suspension of pulp fibers containing surface active carboxyl compounds also contains water-soluble anionic polymer capable of reacting with water-soluble cationic polymer to form a polyelectrolyte complex.

3. The process of claims 1 or 2, wherein the aqueous papermaking suspension is sheeted and dried to obtain paper of improved strength.

4. The process of claim 1, wherein the cationic polymer is a linear polymer.

5. The process of claim 1, wherein the surface active carboxyl compounds are present at from about 0.05 to about 10% by weight based on the dry weight of pulp fibers.

6. The process of claim 1, wherein the compound containing multivalent cation having at least a +3 charge is alum.

7. The process of claim 6 wherein the alum is added at a level of from about 1.5 to about 2.5%, based on the weight of the dry pulp fibers.

8. The process of claim 1 or 2, wherein the order of addition is: 1) compound containing multivalent cation, 2) the cationic polymer, and 3) the anionic polymer.

9. The process of claim 1 or 2, wherein the compound containing multivalent cation and the cationic polymer are mixed together prior to their addition to the aqueous suspension.

10. The process of claim 1 wherein the water-soluble, cationic polymer has a reduced specific viscosity (based on a 0.05 weight % solution in 2 M aqueous NaCl solution at 30° C.) greater than 2 dl/g and a charge density of about 0.2 to about 4 meq/g, and the water-soluble, anionic polymer has a charge density of less than about 5 meq/g.

11. The process of claim 1, wherein the amount of the cationic polymer is about 0.1 to about 5%, on the basis of the dry weight of the pulp fibers.

12. The process of claim 11, wherein the amount of the cationic polymer is from about 0.2 to about 3%.

13. The process of claim 12, wherein the amount of the cationic polymer is from about 0.3 to about 1%.

14. The process of claim 1, wherein the amount of the anionic polymer is 0.1 to 25%, on the basis of the dry weight of the pulp fibers.

15. The process of claim 14, wherein the amount of the anionic polymer is 0.2 to 5%, on the basis of the dry weight of the pulp fibers.

16. The process of claim 15, wherein the amount of the anionic polymer is 0.25 to 2.5%, on the basis of the dry weight of the pulp fibers.

17. The process of claim 1, wherein the cationic polymer is selected from the group consisting of cationic guar and copolymers of acrylamide and diallyldimethylammonium chloride, acryloyloxyethyltrimethylammonium chloride, methacryloyloxyethyltrimethylammonium methyl sulfate, methacryloyloxyethyltrimethylammonium chloride and methacrylamidopropyltrimethylammonium chloride.

18. The process claim 17 wherein the cationic polymer is a copolymer of acrylamide with diallyldimethylammonium chloride or methacryloyloxyethyltrimethylammonium chloride.

19. The process of claim 1, wherein the anionic polymer is selected from the group consisting of anionic materials normally found in pulp, synthetic anionic polymers and anionically modified natural polymers.

20. The process of claim 19, wherein: the anionic materials normally found in pulp are selected from the group consisting of solubilized lignins and hemicelluloses, sulfonated lignins, oxidized lignins and kraft lignin;

the synthetic anionic polymers are selected from the group consisting of copolymers of acrylamide and sodium acrylate, sodium methacrylate and sodium-2-acrylamide-2-methylpropane sulfonate; and poly (sodium-2-acrylamide-2-methylpropane sulfonate); and the anionically modified natural polymers are selected from the group consisting of sodium carboxymethylcellulose, sodium carboxymethyl guar, sodium alginate and sodium polypectate.

21. The process of claims 1 or 2 wherein the pulp comprises unbleached pulp, the cationic polymer comprises a copolymer of acrylamide with diallyldimethylammonium chloride or methacryloyloxyethyltrimethylammonium chloride, the anionic polymer comprises lignin sulfonate, and the compound containing a multivalent cation having at least a +3 charge is alum.

22. The process of claim 6, wherein the alum is at a level of about 1.5 to about 6% by weight, the cationic polymer is at a level of about 0.1 to about 5% by weight, and the anionic polymer is at a level of about 0.1 to about 25% by weights all based on the dry weight of pulp fibers.

23. The process of claim 21 wherein the copolymer of acrylamide with diallyldimethylammonium chloride or methacryloyloxyethyltrimethylammonium chloride is at a level of about 0.1 to about 5% by weight, the lignin sulfate is at a level of about 0.1 to about 25% by weight and the alum is at a level of about 1.5 to about 6%, all based on the dry weight of pulp fibers.

24. A process for preparing an aqueous papermaking suspension containing pulp fibers and a polyelectrolyte complex, comprising:

a) providing an aqueous suspension comprising pulp fibers, surface active carboxyl compounds and water soluble anionic polymer;

b) adding to the aqueous suspension water-soluble cationic polymer that is reactable in the aqueous suspension with the anionic polymer to form the polyelectrolyte complex, and a compound containing a multivalent cation having at least a +3 charge; and c) forming the polyelectrolyte complex;

wherein said compound containing a multivalent cation is added at a level such as to provide an amount of cation equivalent on a molar basis to the amount of aluminum present in alum added at a level of from about 1.5% to about 6% based on the dry weight of pulp fibers.

25. The process of claim 24, wherein the aqueous papermaking suspension is sheeted and dried to obtain paper of improved strength.

26. The process of claim 24, wherein the cationic polymer is a linear polymer.

27. The process of claim 24, wherein the surface active carboxyl compounds are present at from about 0.05 to about 10% by weight based on the dry weight of pulp fibers.

28. The process of claim 24, wherein the compound containing multivalent cation having at least a +3 charge is alum.

29. The process of claim 28, wherein the alum is added at a level of from about 1.5 to about 2.5%, based on the weight of the dry pulp fibers.

30. The process of claim 24, wherein the compound containing multivalent cation is added before addition of the cationic polymer.

31. The process of claim 24, wherein the compound containing multivalent cation and the cationic polymer are mixed together prior to their addition to the aqueous suspension.

32. The process of claim 24, wherein the water-soluble, cationic polymer has a reduced specific viscosity (based on a 0.05 weight % solution in 2 M aqueous NaCl solution at 30° C.) greater than 2 dl/g and a charge density of about 0.2 to about 4 meq/g, and the water-soluble, anionic polymer has a charge density of less than about 5 meq/g.

33. The process of claim 24, wherein the amount of the cationic polymer is about 0.1 to about 5%, on the basis of the dry weight of the pulp fibers.

34. The process of claim 33, wherein the amount of the cationic polymer is from about 0.2 to about 3%.

35. The process of claim 34, wherein the amount of the cationic polymer is from about 0.3 to about 1%.

36. The process of claim 24, wherein the amount of the anionic polymer is 0.1 to 25%, on the basis of the dry weight of the pulp fibers.

37. The process of claim 36, wherein the amount of the anionic polymer is 0.2 to 5%, on the basis of the dry weight of the pulp fibers.

38. The process of claim 37, wherein the amount of the anionic polymer is 0.25 to 2.5%, on the basis of the dry weight of the pulp fibers.

39. The process of claim 24, wherein the cationic polymer is selected from the group consisting of cationic guar and copolymers of acrylamide and diallyldimethylammonium chloride, acryloyloxyethyltrimethylammonium chloride, methacryloyloxyethyltrimethylammonium methyl sulfate, methacryloyloxyethyltrimethylammonium chloride and methacrylamidopropyltrimethylammonium chloride.

40. The process claim 39, wherein the cationic polymer is a copolymer of acrylamide with diallyldimethylammonium chloride or methacryloyloxyethyltrimethylammonium chloride.

41. The process of claim 24, wherein the water-soluble anionic polymers are selected from the group consisting of solubilized lignins and hemicelluloses, sulfonated lignins, oxidized lignins and kraft lignin.

42. The process of claim 24, wherein the pulp comprises unbleached pulp, the cationic polymer comprises a copolymer of acrylamide with diallyldimethylammonium chloride or methacryloyloxyethyltrimethylammonium chloride, the anionic polymer comprises lignin sulfonate, and the compound containing multivalent cation having at least a +3 charge is alum.

43. The process of claim 28, wherein the alum is at a level of about 1.5 to about 6% by weight, the cationic polymer is at a level of about 0.1 to about 5% by weight, and the anionic polymer is at a level of about 0.1 to about 25% by weight, all based on the dry weight of pulp fibers.

44. The process of claim 42, wherein the copolymer of acrylamide with diallyldimethylammonium chloride or methacryloyloxyethyltrimethylammonium chloride is at a level of about 0.1 to about 5% by weight, the lignin sulfate is at a level of about 0.1 to about 25% by weight and the alum is at a level of about 1.5 to about 6%, all based on the dry weight of pulp fibers.

45. Paper prepared by the process of claim 3.

46. Paper prepared by the method of claim 25.

* * * * *